US007492909B2

(12) United States Patent
Carter, Jr.

(10) Patent No.: US 7,492,909 B2
(45) Date of Patent: Feb. 17, 2009

(54) METHOD FOR ACOUSTIC TRANSDUCER CALIBRATION

(75) Inventor: Charles H. Carter, Jr., Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 1475 days.

(21) Appl. No.: 09/826,503

(22) Filed: Apr. 5, 2001

(65) Prior Publication Data

US 2002/0146136 A1 Oct. 10, 2002

(51) Int. Cl.
*H04R 29/00* (2006.01)

(52) U.S. Cl. ..... 381/58; 381/59

(58) Field of Classification Search ..... 381/56, 381/58, 59, 103, 111–115, 93, 95, 96, 98, 381/60; 324/601; 340/514, 501, 870.04; 333/28 T; 367/13; 379/26.02, 27.03, 390.02; 455/425, 550.1, 570, 67.14; 702/103, 111
See application file for complete search history.

(56) References Cited

U.S. PATENT DOCUMENTS 3,912,880 A * 10/1975 Powter et al. ..... 379/27.08
4,118,601 A * 10/1978 Yeap ..... 381/103
4,631,749 A * 12/1986 Rapaich ..... 381/103
5,339,362 A * 8/1994 Harris ..... 381/86
5,481,615 A * 1/1996 Eatwell et al. ..... 381/71.6
5,771,297 A * 6/1998 Richardson ..... 381/57
5,881,103 A * 3/1999 Wong et al. ..... 375/229

* cited by examiner

*Primary Examiner*—Brian Ensey
(74) *Attorney, Agent, or Firm*—Barbara R. Doutre

(57) ABSTRACT

A method of acoustic transducer calibration (200, 400) using a band limited pseudo random noise source with an internal digital signal processor (209, 403) to tailor audio characteristics of an internal microphone 103 and internal speaker (301) within a communications device (101) to insure consistent amplitude and frequency characteristics of these microphone and speaker transducer devices. The method offers and advantage such that tuning of the amplitude and frequency response consistently converges to the desired filter response with a filter type offering operational stability.

3 Claims, 2 Drawing Sheets

METHOD FOR ACOUSTIC TRANSDUCER CALIBRATION

TECHNICAL FIELD

This invention relates in general to acoustic calibration and more specifically acoustic calibration for speaker and microphone anomalies as used in communications equipment.

BACKGROUND

Many portable communications devices use some variety of transducer. A transducer can include such devices as a microphone to convert acoustic energy to electrical energy or a speaker to convert the electrical energy back to acoustic energy. Ideally, it is important to achieve some type of predetermined frequency response and gain from these devices in order for the communications device to operate most effectively. A transducer with a wide frequency response enables a complete spectrum of audio frequencies to be reproduced which are typically between 300 to 3000 Hertz (Hz). However, the acoustic responses of these transducer devices unfortunately are non-ideal, inconsistent and often have poor operational characteristics. This is due to such things as environmental factors, the mechanical placement of the transducer and/or variations in their manufacture.

For example, a typical microphone used in a two-way radio device often can have a gain of +/−3 decibel (dB) as specified by most manufacturers. In the design and operation of two-way radio or cellular devices, this can make it difficult to electrically balance audio to the input circuitry of the device. This is due to wide variations in both microphone gain and frequency response. This same example is also applicable to the communications speaker output which often causes a user using numbers of similar types of communications equipment difficulty in maintaining a similar operating radio when comparing two devices. More often than not, this causes the user to falsely determine that a radio is defective when in-fact only slight acoustic variations in operation between either microphone or speaker cause each radio to sound differently to the user.

Therefore, the need exists to provide a system for acoustic microphone and speaker calibration that will enable an electronic device to operate consistently regardless of slight operational dissimilarities between the microphone and speaker components.

DETAILED DESCRIPTION OF THE PREFERRED EMBODIMENT

Figure 1:
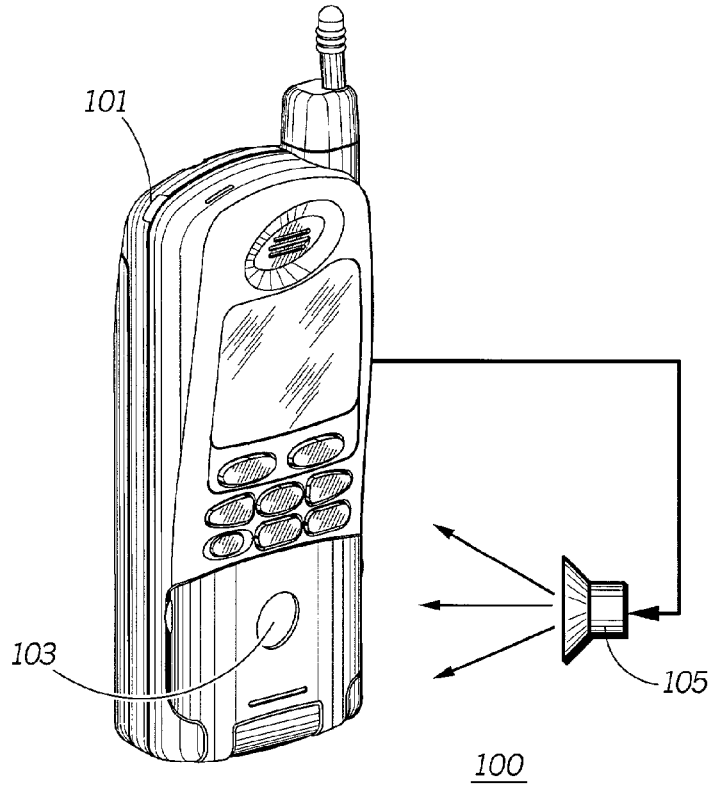
FIG. 1 is a block diagram showing acoustic calibration of a microphone in a portable communications device.

Referring now to FIG. 1, a portable two-way communications device 101 such as a two-way radio or cellular telephone includes an internal speaker and internal microphone 103. In the preferred embodiment of the invention, during the acoustic calibration of a microphone 103, a characterized external speaker 105 is attached to the communications device 101 that is used to produce audible pseudo random noise generated by an internal digital signal processor (DSP). The pseudo random noise is directed toward the microphone 103. As is well known in the art, acoustic band limited pseudo random noise is often referred to as "pink noise" and is audio generated over the audible frequency range of 300 Hz to 3 KHz.

Figure 2:
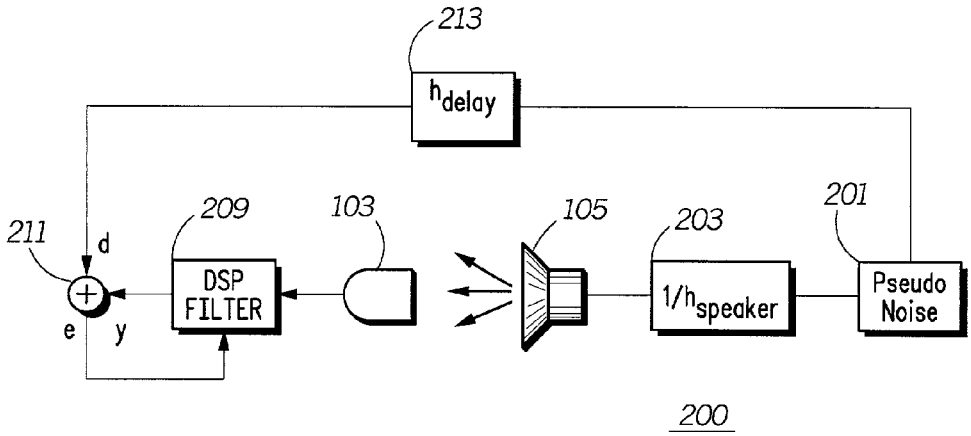
FIG. 2 is a block diagram showing the method of acoustic calibration of a microphone according to the preferred embodiment of the invention.

FIG. 2 depicts a block diagram showing the method of acoustic calibration of the microphone 103 according to the preferred embodiment of the invention. Pseudo random noise 201 is generated and supplied to a filter 203. The pseudo random noise can be generated either internally from the communications device or from an external source. The filter 203 acts to tailor the frequency response of the external speaker 105 in order to provide optimized frequency and gain characteristics for microphone calibration where "h" is the frequency response of the speaker and "1/h speaker" is the inverse frequency response. 1/h speaker is used to denote the combination of frequency responses to produce a "flat" frequency response. Thus, filter 203 effectively normalizes the frequency and gain response of the speaker 105 used for calibration of the microphone 103. DSP 209, as discussed hereinafter, is the actual device the optimizes the characteristics of microphone 103.

The amplitude of the pseudo random noise coming from speaker 105 is sufficient enough such that it is supplied to the input of microphone 103. Although microphone 103 is shown as an internal microphone, it will be evident to those skilled in the art the an external speaker microphone, such as a speaker microphone, could be calibrated using this method as well. The output of the microphone 103 is directed to a digital signal processor (DSP) type audio filter 209. As is well known in the art, the DSP 209 acts to transform the analog microphone input and convert it to a digital signal where it can be easily processed and manipulated to add, remove or alter its signal characteristics. These signal characteristics include but are not limited to amplitude or frequency components.

In order to control the DSP filter 209, a comparison 211 is made between the output of the pseudo noise signal which represents a "desired" signal (d) and an output of the DSP filter 209 (y). A delay 213 is provided to the pseudo random noise generator so as to allow proper synchronization between noise signals as each travels by separate paths though the audio chain. As seen in FIG. 2, this chain is comprised of speaker 10, microphone 103 and DSP filter 209 An error signal (e) is produced at the output of the comparator 211 that is directed to the DSP filter 209. The error signal works to control a plurality of signal coefficients in various DSP algorithms used to process the analog signal from microphone 103. The filter coefficients are changed to provide an optimized microphone output to enable the two-way communications device to operate by having consistent gain and frequency components from the output of the its microphone 103. It will be evident to those skilled in the art that after the calibration of the microphone 103 the DSP filter 209 will continue to use the same calculated frequency coefficients in order to provide optimized audio to the communications device 101 from microphone 103. It is important to note that FIG. 2 represents a unique system identification adaptive microphone filter structure which converges directly to the inverse filter in a fixed input response (FIR) structure which has no stability issues.

Figure 3:
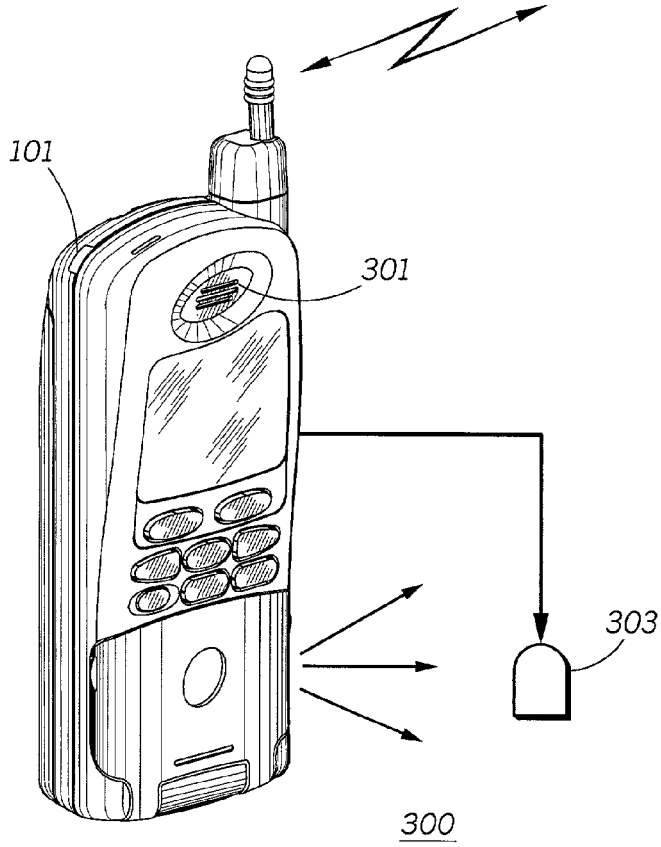
FIG. 3 is a block diagram showing the acoustic calibration of an internal speaker in a portable communications device.

FIG. 3 illustrates a block diagram showing the acoustic calibration of an internal speaker 301 in a portable communications device according to the preferred embodiment of the invention. FIG. 3 shows the portable communications device 101 with internal speaker 301 that is typically located within the device. As will be evident to those skilled in the art, although the discussion herein will be directed to an internal microphone, calibration of an external microphone or speaker such as a handheld public safety microphone would also be possible using this method.

In order to calibrate the internal speaker 301, pseudo random noise is delivered from the speaker 301 at an amplitude such that it can be detected either by the calibrated internal microphone 103 or an external microphone 303. Moreover, as shown by the block diagram in FIG. 4, the pseudo random noise may be generated either by the internal DSP or an external source. After detection by the external microphone 303, the detected audio is then filtered by filter 406 in order to obtain the desired amplitude and frequency response from the microphone 303. As noted previously, "h" denotes the frequency response and "1/h mic" is the inverse frequency response of the microphone. Both the h response and 1/h response are combined to produce a "flat" response.

Filter 203 effectively normalizes the frequency and gain response of the speaker 105 used for calibration of the microphone 103. DSP 209 is the actual device the optimizes the characteristics of microphone 103. Preferably the external microphone 303 has already been previously calibrated according to the methods as defined herein. The output (y) of the filter 401 is then compared 405 with the pseudo noise generator 201 (d).

The output of the pseudo noise generator 201 is delayed 407 before comparison in order to insure the timing and synchronization is correct between both noise signals as they travel though the audio chain of the portable communications device. Based on this comparison, an error signal (e) is produced at the output of the comparator 405 that is directed to the DSP filter 403. As with the microphone calibration, the error signal works to control a plurality of signal coefficients in the DSP algorithms used to process the analog signal before entering speaker 301.

Figure 4:
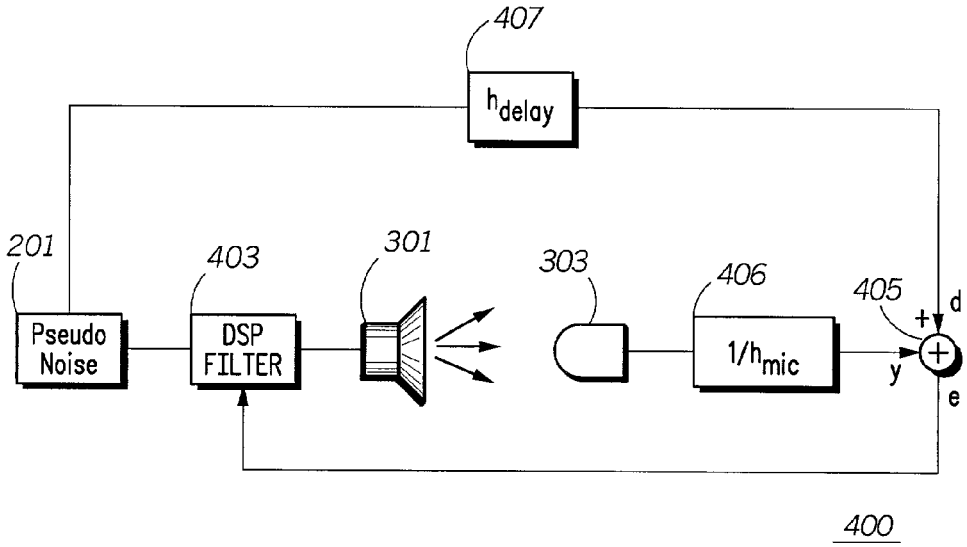
FIG. 4 is a block diagram showing the method of acoustic calibration of an internal speaker according to the preferred embodiment of the invention.

The filter coefficients are then changed to provide an optimized speaker input to enable the internal speaker 301 in the two-way communications device to operate by having consistent gain and frequency components from the output of the its speaker 301. It will be evident to those skilled in the art that after the calibration of the speaker 301 the DSP filter 209 will continue to use the same calculated frequency coefficients in order to provide optimized audio to the communications device 101 from speaker 301. It is important to note that FIG. 4 represents a unique system identification adaptive speaker filter structure which converges directly to the inverse filter in a fixed input response (FIR) structure which has no stability issues.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method for acoustic transducer calibration in a portable communications device comprising the steps of:

providing a source of pseudo random acoustical noise to a characterized external speaker source separate from the portable communications device;

directing the pseudo random acoustical noise to an input of an internal microphone used with the portable communications device;

adjusting first coefficients in at least one digital signal processor connected to the internal microphone for a desired microphone frequency response based upon the input of pseudo random acoustical noise;

discontinuing the source of pseudo random acoustical noise from the external speaker source;

applying the source of pseudo random acoustical noise to an internal speaker source in the portable communications device;

increasing the amplitude of the pseudo random acoustic noise such that it can be detected by the internal microphone;

adjusting second coefficients in the at least one digital signal processor for a desired internal speaker frequency response based upon the input of the pseudo random acoustical noise;

returning the portable communications device to an operational mode; and utilizing a filter between the source of pseudo random acoustical noise and the external speaker to compensate for irregularities in the frequency response of the external speaker.

2. A method of acoustic transducer calibration as in claim 1 further including the step of:

comparing the output of the at least one digital signal processor with an optimal acoustic signal from the output of the pseudo random acoustic noise to provide an error signal for adjusting the coefficients of the at least one digital signal processor.

3. A method of acoustic transducer calibration as in claim 1 wherein the source of pseudo random noise is from the at least one digital signal processor.

* * * * *